US005320236A

United States Patent [19]

Gregory

[11] Patent Number: 5,320,236

[45] Date of Patent: Jun. 14, 1994

[54] PLASTIC CONTAINER PACKAGE WITH LINERLESS SEALING CLOSURE SYSTEM

[75] Inventor: James L. Gregory, Toledo, Ohio

[73] Assignee: Owens-Illinois Closure Inc., Toledo, Ohio

[21] Appl. No.: 19,982

[22] Filed: Feb. 17, 1993

Related U.S. Application Data

[63] Continuation of Ser. No. 874,485, Apr. 27, 1992, abandoned.

[51] Int. Cl.[5] ..... B65D 53/00

[52] U.S. Cl. ..... 215/344; 215/341; 215/DIG. 1

[58] Field of Search ..... 215/341, 343, 344, 354, 215/DIG. 1

[56] References Cited

U.S. PATENT DOCUMENTS

| | | | |
|---|---|---|---|
| 3,053,406 | 9/1962 | Wandell . | |
| 3,067,900 | 12/1962 | Kessler . | |
| 3,203,571 | 8/1965 | Plunkett | 215/344 |
| 3,232,470 | 2/1966 | Gibson | 215/344 |
| 3,255,907 | 6/1966 | Eddy | 215/DIG. 1 X |
| 3,255,909 | 6/1966 | Miller . | |
| 3,393,818 | 7/1968 | McIntosh . | |
| 3,802,590 | 4/1974 | Culver . | |
| 4,061,240 | 12/1977 | Brownbill | 215/270 |
| 4,069,937 | 1/1978 | Smalley . | |
| 4,196,818 | 4/1980 | Brownbill . | |
| 4,220,250 | 9/1980 | Brownbill . | |
| 4,398,645 | 8/1983 | Toeppen . | |
| 4,442,947 | 4/1984 | Banich, Sr. | 215/344 |
| 4,450,973 | 5/1984 | Toeppen . | |
| 4,530,437 | 7/1985 | Gray et al. | 215/252 |
| 4,540,102 | 9/1985 | Wiedmer | 215/344 |
| 4,560,077 | 12/1985 | Dutt | 215/307 |
| 4,598,835 | 7/1986 | Brownbill | 215/307 |
| 4,739,893 | 4/1988 | Zumbuhl . | |
| 4,872,304 | 10/1989 | Thompson . | |
| 4,907,709 | 3/1990 | Abe et al. | 215/252 |
| 4,971,213 | 11/1990 | Ishinabe et al. | 215/344 |

FOREIGN PATENT DOCUMENTS

| | | | |
|---|---|---|---|
| 115754 | 11/1969 | Denmark | 215/343 |
| 2021530 | 4/1979 | United Kingdom | 215/343 |

*Primary Examiner*—Gary E. Elkins
*Assistant Examiner*—Vanessa Caretto

[57] ABSTRACT

A plastic container closure package with a linerless sealing closure system comprising a plastic container having a threaded finish for receiving a closure having a base wall and an internal skirt with complementary threads on the skirt. The plastic container is made by a process wherein a tube of molten plastic is inflated and blown to form the container and thereafter the tube is trimmed to form the sealing surface of the finish of the container. The closure includes an annular flange that extends downwardly from the underside of the base wall of the closure and radially inwardly of the closure for engagement with the container. The annular flange includes a smooth continuous frustoconical surface that faces the finish of the container and engages the inner edge at the juncture of the top surface and inside surface of the finish of the container. An annular stop extends axially from the underside of the base wall of the closure to limit the flexing of the annular flange. The width of the flange is such that the free end thereof normally extends beyond the inner edge of the finish into sealing engagement intermediate the free edge and the end of the flange.

7 Claims, 2 Drawing Sheets

PLASTIC CONTAINER PACKAGE WITH LINERLESS SEALING CLOSURE SYSTEM

This is a continuation of copending application Ser. No. 07/874,485, filed on Apr. 27, 1992, now abandoned.

This invention relates to a plastic container package including a linerless sealing closure system.

BACKGROUND AND SUMMARY OF THE INVENTION

When plastic containers are utilized to retain liquids such as oil or water, it has been found that it is necessary that the closure utilized with the container have a separate liner in order to provide an adequate seal. The problem of sealing is made even more complex where the plastic container is made by closing molds about a tube of molten plastic material and blowing the tube followed by thereafter cutting and trimming the portion of the tube that has been blown into a finish to provide a sealing surface on the upper end of the finish. The trimming process often results in variation in the plane of the finish at circumferentially spaced points along the sealing surface as well as non-uniformity in a radial direction. The trimming process can result in variations in height circumferentially of the finish, known as "trim slant". The trimming can also result in the top surface being inclined rather than being perpendicular to the longitudinal axis of the container. In addition, in such a molding process wherein the tube is extruded variations in diameter of the finish can occur circumferentially known as ovality. Each of these conditions can result in failure of the seal so that it has thought to be necessary to utilize a sealing liner in the closure. Sealing on such a container is also made more difficult due to variations or imperfections in the seam produced adjacent the juncture of the closed molds.

Various patents have been proposed including flanges extending radially outwardly and inwardly as shown in U.S. Pat. Nos. 3,053,406, 3,067,900, 3,255,909, 3,393,818 3,802,590, 4,069,937, 4,196,818, 4,220,250, 4,398,645, 4,422,947, 4,450,973, 4,598,835, 4,739,893 and 4,872,304.

As far as the present inventor is aware, none of these patents has been directed to the problems of the present invention or resulted in a satisfactory package for liquids.

Among the objectives of the present invention are to provide a package for a plastic container made by the aforementioned process which does not require a separate liner and utilizes a linerless sealing closure system which will compensate for any unevenness and out-of-round top surfaces on the finish of the container; and which container package will be capable of packaging oil, water or similar fluids.

In accordance with the invention a plastic container closure package with a linerless sealing closure system comprising a plastic container having a threaded finish for receiving a closure having a base wall and an internal skirt with complementary threads on the skirt. The plastic container is made by a process wherein a tube of molten plastic is inflated and blown to form the container and thereafter the tube is trimmed to form the sealing surface of the finish of the container. The closure includes an annular flange that extends downwardly from the underside of the base wall of the closure and radially inwardly of the closure for engagement with the sealing surface on the container. The annular flange includes a smooth continuous frustoconical surface that faces the finish of the container and engages the inner edge at the juncture of the top surface and inside surface of the finish of the container. An annular stop extends axially from the underside of the base wall of the closure to limit the flexing of the annular flange. The width of the flange is such that the free end thereof normally extends beyond the inner edge of the finish surface into sealing engagement intermediate the free edge and the end of the flange.

DESCRIPTION

Figure 1:
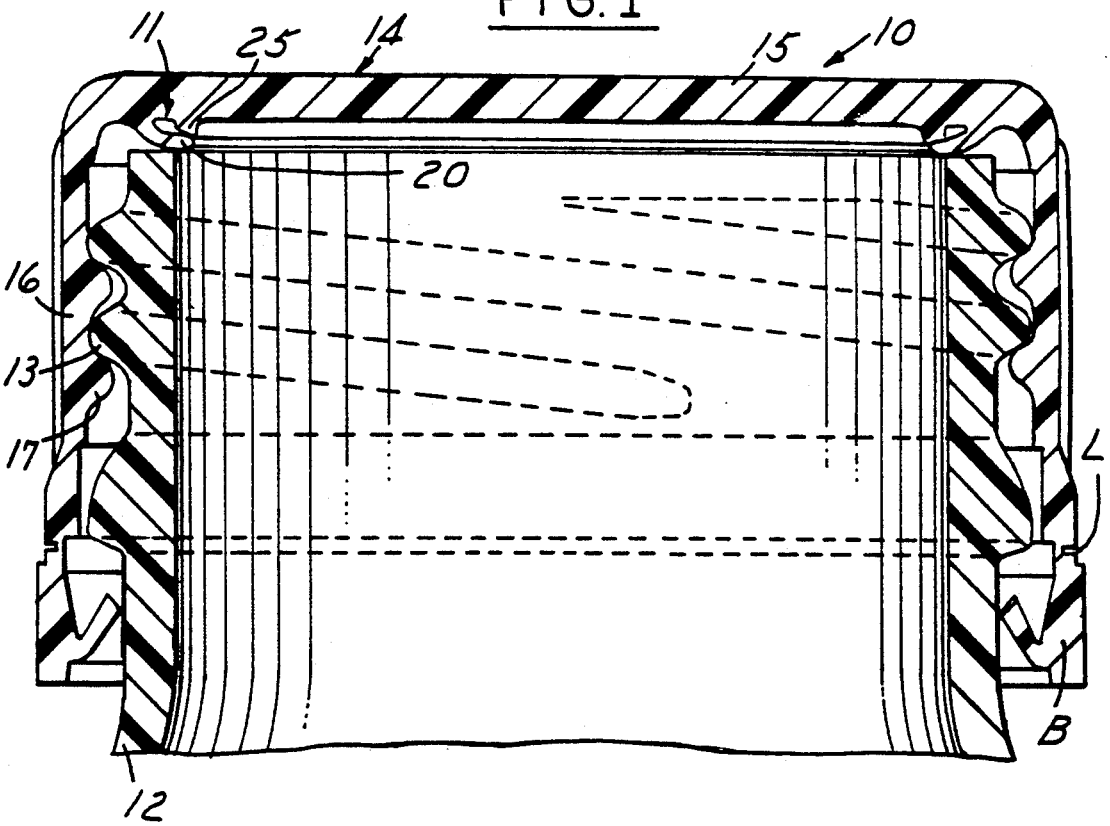
FIG. 1 is a fragmentary sectional view on an enlarged scale of a container package embodying the invention.
Figure 2:
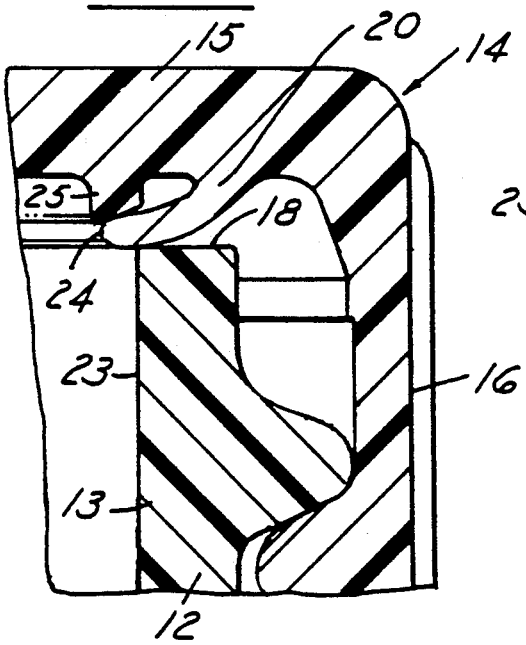
FIG. 2 is a fragmentary sectional view on an enlarged scale of a portion of the package shown in FIG. 1.
Figure 3:
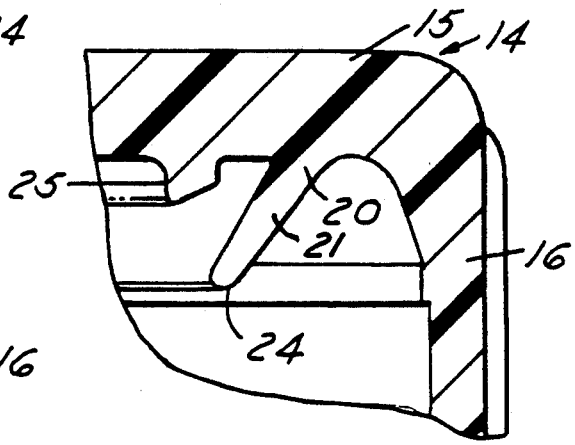
FIG. 3 is a fragmentary sectional view of a portion of the closure before application to the container.

In accordance with the invention, a plastic container closure package 10 with a linerless sealing closure system comprising a plastic container 12 having an external threaded finish 13 for receiving a plastic closure 14 which has a base wall 15 and an integral skirt 16 with complementary threads 17 on the skirt 16.

The plastic container 12 is made by a process wherein a tube of molten plastic is extruded, blow molds are closed over the tube and the tube is blown to form the container. Thereafter the tube finish or neck of the container is trimmed to form the sealing surface of the finish of the container. The trimming process can result in variations in height circumferentially of the finish, known as "trim slant". The trimming can also result in the top surface being inclined rather than being perpendicular to the longitudinal axis of the container. In addition, in such a molding process wherein the tube is extruded variations in diameter of the finish can occur circumferentially known as ovality. Each of these conditions can result in failure of the seal so that it has thought to be necessary to utilize a sealing liner in the closure. Sealing on such a container is also made more difficult due to variations or imperfections in the seam produced adjacent the juncture of the closed molds.

The trimmed container is intended to provide a top surface 18 which is perpendicular to the longitudinal axis of the container 12.

The closure 14 includes an annular flange 20 that extends downwardly from the underside of the base wall 15 of the closure 14 and radially inwardly of the closure 14 for engagement with the container 12. The annular flange 20 includes a smooth continuous frustoconical surface 21 that faces the finish 13 of the container 12 and is designed to engage the inner edge 22 at the juncture of the top surface 18 and inner surface 23 of the finish 13. The flange 20 includes a free annular edge 24 that is rounded at least at portion facing the finish 13. The width of the flange 20 is such that the free edge 24 thereof normally extends beyond the top surface 18 into sealing engagement intermediate the free edge 24 and the other end of the flange 20 extending from the underside of the base wall 15. The flange 20 has its greatest thickness adjacent the base wall 15 and tapers and converges toward the free edge 24. An annular stop 25 extends axially from the underside of the base wall 15 of the closure 14 to limit the flexing of the annular flange 20.

The container and closure are preferably made of high density polyethylene but may also be made of other plastics such as other polyethylenes or polypropylenes.

The closure 14 also preferably includes a tamper indicating band B connected to the skirt 16 along a weakened line L, such as shown in U.S. application Ser. No. 07/386,391 filed Jul. 27, 1989, incorporated herein by reference.

The closure system forming part of package will accommodate for unevenness and out-of-round conditions.

Figure 4:
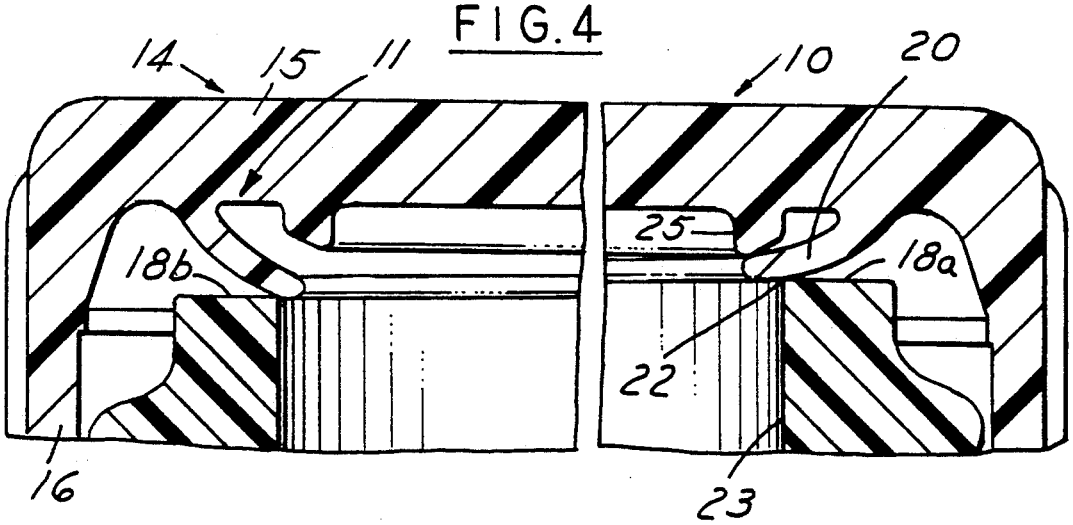
FIGS. 4, 5 and 6 are fragmentary sectional views of closure packages which show the manner in which the closure compensates for variations in height and non-perpendicular surfaces on the finish of the container.
Figure 5:
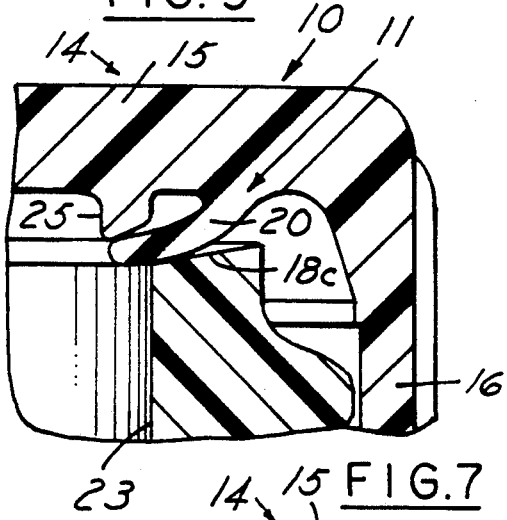

For example i.e. as shown in FIG. 4, the level or axial distance between one side of the container top surface as at 18*a* and differs from the other side 18*b*, known as trim slant, the differential flexing along the periphery of the flange 20 accommodates for the variation in height of the top surface 18. As shown in FIG. 5, if the top surface 18*c* is cut so that it is inclined on one side so that it tapers downwardly and axially inwardly, the flange 20 will also accommodate such situations or variation.

Figure 6:
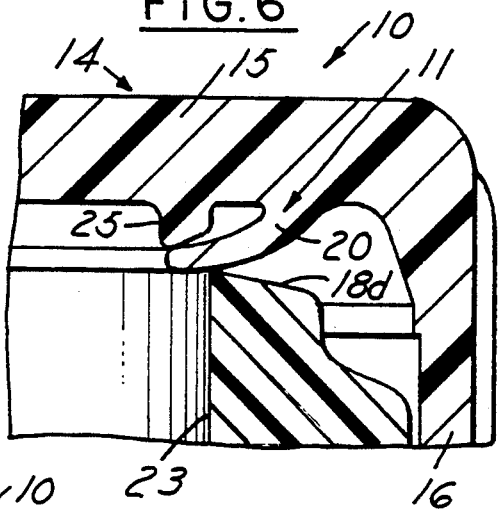

If as shown in FIG. 6, the top surface 18*d* is tapered in the opposite direction from that shown in FIG. 5, the annular flange 20 will also provide a proper seal. If there is a variation in out-of-round condition of the finish, the ability of the flange 20 to engage at various portions along its width will accommodate and provide the satisfactory seal under those conditions.

It has been found that in tests as represented by the following, the plastic container package with linerless sealing closure system effectively seals the package where the contents are, for example, liquids such as motor oil or water and the like.

Figure 7:
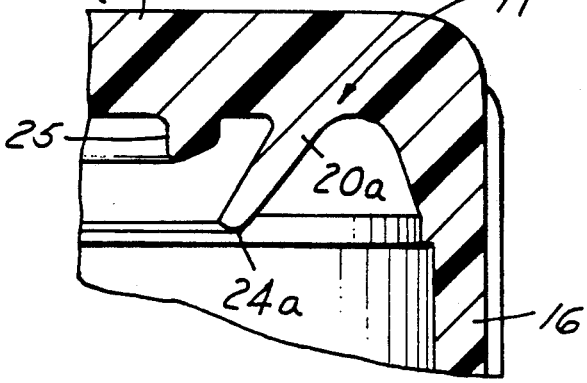
FIG. 7 is a view similar to FIG. 2 of a modified form of closure that can be used in the container package.

In the form shown in FIG. 7, the flange 20*a* has a partial rounded free edge 24*a* facing the finish 13 to facilitate manufacture.

It can thus be seen that the container package effectively compensates for time slant, non-perpendicularity of the top surface of the finish and ovality of the finish. In addition since the sealing is designed to occur at the inner edge of the juncture of the top surface and inside surface of the finish, the problems of sealing at the seam of the container are obviated. Furthermore since the seal is at the inner edge of the finish, the liquid is kept from the seal area.

The container package will provide a satisfactory seal even though the container can vary from the ideal as indicated in the following representative measurement of diameters, ovality and trim slant of 32 oz high density polyethylene bottles from different cavities made by the extrusion, blow and trim process heretofore described:

| A Diameter | | | B Ovality | | |
|---|---|---|---|---|---|
| Min./Max | aver | ovality | aver | ovality | Trim Slant |
| .971/.991 | .981 | .020" | 1.099 | .016" | .018" |
| .966/.986 | .976 | .020 | 1.095 | .014 | .016 |
| .967/.990 | .979 | .023 | 1.096 | .020 | .020 |
| .971/.986 | .979 | .015 | 1.097 | .012 | .021 |
| .975/.990 | .983 | .015 | 1.098 | .015 | .020 |
| .970/.988 | .979 | .018 | 1.094 | .018 | .020 |
| .970/.979 | .975 | .009 | 1.092 | .010 | .020 |
| .965/.978 | .972 | .013 | 1.090 | .012 | .020 |
| .964/.978 | .971 | .014 | 1.091 | .016 | .022 |
| .954/.980 | .967 | .026 | 1.087 | .018 | .015 |

-continued

| A Diameter | | | B Ovality | | |
|---|---|---|---|---|---|
| Min./Max | aver | ovality | aver | ovality | Trim Slant |
| .967/.981 | .974 | .014 | 1.093 | .015 | .019 |
| .961/.981 | .971 | .020 | 1.094 | .016 | .016 |
| .960/.980 | .970 | .020 | 1.094 | .017 | .028 |
| .959/.984 | .972 | .025 | 1.094 | .023 | .026 |
| .958/.983 | .971 | .025 | 1.094 | .019 | .028 |
| .955/.968 | .962 | .013 | 1.089 | .010 | .027 |
| .961/.977 | .969 | .016 | 1.092 | .011 | .016 |
| .960/.972 | .966 | .012 | 1.092 | .011 | .021 |

Tests performed on container packages with motor oil utilizing prior art closures with a liner as a standard or contest and container packages for oil embodying the invention show no leakage within 24 hours or one week when case containing such packages were inverted and stand on pallets under warehouse conditions.

It can thus be seen that there has been provided a package for a plastic container made by the aforementioned process which does not require a separate liner and utilizes a linerless sealing closure system which will compensate for any unevenness and out-of-round top surfaces on the finish of the container; and which container package will be capable of packaging oil, water or similar fluids.

I claim:

1. A plastic container and closure package for liquids with a linerless sealing closure system comprising a plastic container and a closure, said plastic container having a threaded finish for receiving a closure, said finish having an upper end axially above the threads, said finish having a substantially flat top surface, an outer surface and an inner surface, said outer surface and said inner surface intersecting said top surface to define an inner edge and an outer edge, said plastic container having a finish that has at least one variation comprising at least one of a variation in height circumferentially; a variation in inclination of the top surface of said finish; a variation in out-of-round; a variation in ovality of said finish, and a variation in a molding seam produced adjacent a seam formed by closed molds used in making the container, said plastic closure having a base wall and a peripheral skirt with complementary threads on the skirt engaging said threaded finish, said base wall having an underside, said closure including a single integral annular flexible flange that extends downwardly from the underside of the base wall of the closure and radially inwardly of the closure, and a continuous annular stop that extends axially from the underside of the base wall, said annular flexible flange having a smooth continuous frustoconical surface facing said finish and a free edge, the portion of the flange adjacent the base wall of the closure overlying the top surface of the finish, said flange normally being out of contact with the base wall and engaging one of the inner edge and the top surface at said inner edge of said finish of said container to provide sealing engagement with said inner edge when the closure is fully applied by threading the closure onto the container, such that the flange is free of any contact with the outer edge of the finish at all times wherein a variation in the molding seam may interfere with sealing; and said flange comprising the sole sealing engagement with said upper end of said finish of said plastic container and accommodating any variations in height and inclination in the top surface of said finish, out-of-round or ovality of the finish of the plastic container, and imperfections in the seam produced adjacent the juncture of closed molds used in making the container, the width and position of the flange being such that the free edge thereof normally extends beyond the inner edge of the finish and the sealing engagement is normally intermediate the free edge of said flange and said base wall, said flange being capable of flexing intermediate the free edge and the portion adjacent the base wall such that the free edge may move toward the base wall and such that the flange is capable of flexing differentially about the periphery of the flange such that if the variation is one in which the height of the top surface of the finish varies circumferentially, the flange flexes differently about the periphery of the flange and;

such that if the variation is in the top surface of the finish being inclined downwardly and inwardly on one side, the flange flexes differentially about the periphery of the flange and;

such that if the variation is in the top surface of the finish being inclined downwardly and outwardly, the flange flexes differentially about the periphery of the flange, and;

such that if the variation is in the finish being out-of-round, the flange flexes differentially to engage the inner edge of the finish at different portions of its width and;

so that the closure effectively accommodates any variations in height and inclination of the top surface of the finish due to trimming and variations in out-of-round or ovality of the finish or imperfections in the same produced adjacent the juncture of closed molds used in making the container.

2. The plastic container package as set forth in claim 1 including an annular stop extending axially from the underside of the base wall of the closure, the free edge of the flange underlies the stop but being normally out of engagement with said stop, to limit the flexing of the annular flange.

3. The plastic container package set forth in claim 1 wherein said flange has its greater width adjacent the base wall of the closure and has sides converging toward the free edge of the flange.

4. The plastic container package set forth in claim 3 wherein said free edge of said flange is rounded at least along a portion thereof facing said finish.

5. The plastic container set forth in claim 4 wherein the free edge of said flange is rounded.

6. The container package set forth in claim 1 wherein said container and said closure are made of high density polyethylene.

7. The plastic container package set forth in any one of claims 1-4 wherein said plastic container has been made by closing molds about a tube of molten plastic material, blowing the tube to form a container having a seam and thereafter cutting and trimming the finish.

* * * * *